US005580003A

United States Patent [19]

Malone et al.

[11] Patent Number: 5,580,003

[45] Date of Patent: Dec. 3, 1996

[54] METHOD FOR CONTROLLING A GYRATORY CRUSHER

[75] Inventors: William Malone, Motherwell, United Kingdom; Arvid L. Svensson, Bunkeflostrand, Sweden; Alexander J. Scott, Lanarks, United Kingdom

[73] Assignee: Svedala Arbra AB, Svedale, Sweden

[21] Appl. No.: 122,580

[22] PCT Filed: Jan. 29, 1993

[86] PCT No.: PCT/SE93/00069

§ 371 Date: Jan. 31, 1994

§ 102(e) Date: Jan. 31, 1994

[87] PCT Pub. No.: WO93/14870

PCT Pub. Date: Aug. 5, 1993

[30] Foreign Application Priority Data

Jan. 31, 1992 [SE] Sweden ..... 9200289

[51] Int. Cl.[6] ..... B02C 2/00; B02C 25/00

[52] U.S. Cl. ..... 241/36; 241/36

[58] Field of Search ..... 241/30, 37, 36, 241/207

[56] References Cited

U.S. PATENT DOCUMENTS

| | | | |
|---|---|---|---|
| 4,712,743 | 12/1987 | Nordin | 241/30 |
| 4,793,560 | 12/1988 | Schrodl | 241/30 |
| 4,856,716 | 8/1989 | Burstedt | 241/30 |
| 4,967,967 | 11/1990 | Magerowski et al. | 241/21 |

FOREIGN PATENT DOCUMENTS

| | | |
|---|---|---|
| 429237A2 | 5/1991 | European Pat. Off. . |
| 456798 | 4/1986 | Sweden . |
| 456138 | 3/1988 | Sweden . |
| PCT/EP86/00519 | 9/1986 | WIPO . |

*Primary Examiner*—John M. Husar
*Attorney, Agent, or Firm*—Luedeka, Neely & Graham, P.C.

[57] ABSTRACT

A gyratory crusher has two crushing shells (4, 5) defining between them a crushing gap (6). In operation, the crushing gap is adjusted as a function of the determined crushing-shell wear calculated on the basis of reference data on the established rate of wear of the crushing shells (4, 5) in previous crushing operations involving the same or a similar raw material. To adjust the particle size distribution of the crushed goods and obtain the desired particle size distribution curve, the crusher is operated with brief periods of alternatingly different settings of the width of the crushing gap (6) and/or with alternating crushing power or crushing force.

10 Claims, 2 Drawing Sheets

FIG.I

METHOD FOR CONTROLLING A GYRATORY CRUSHER

Figure 1:
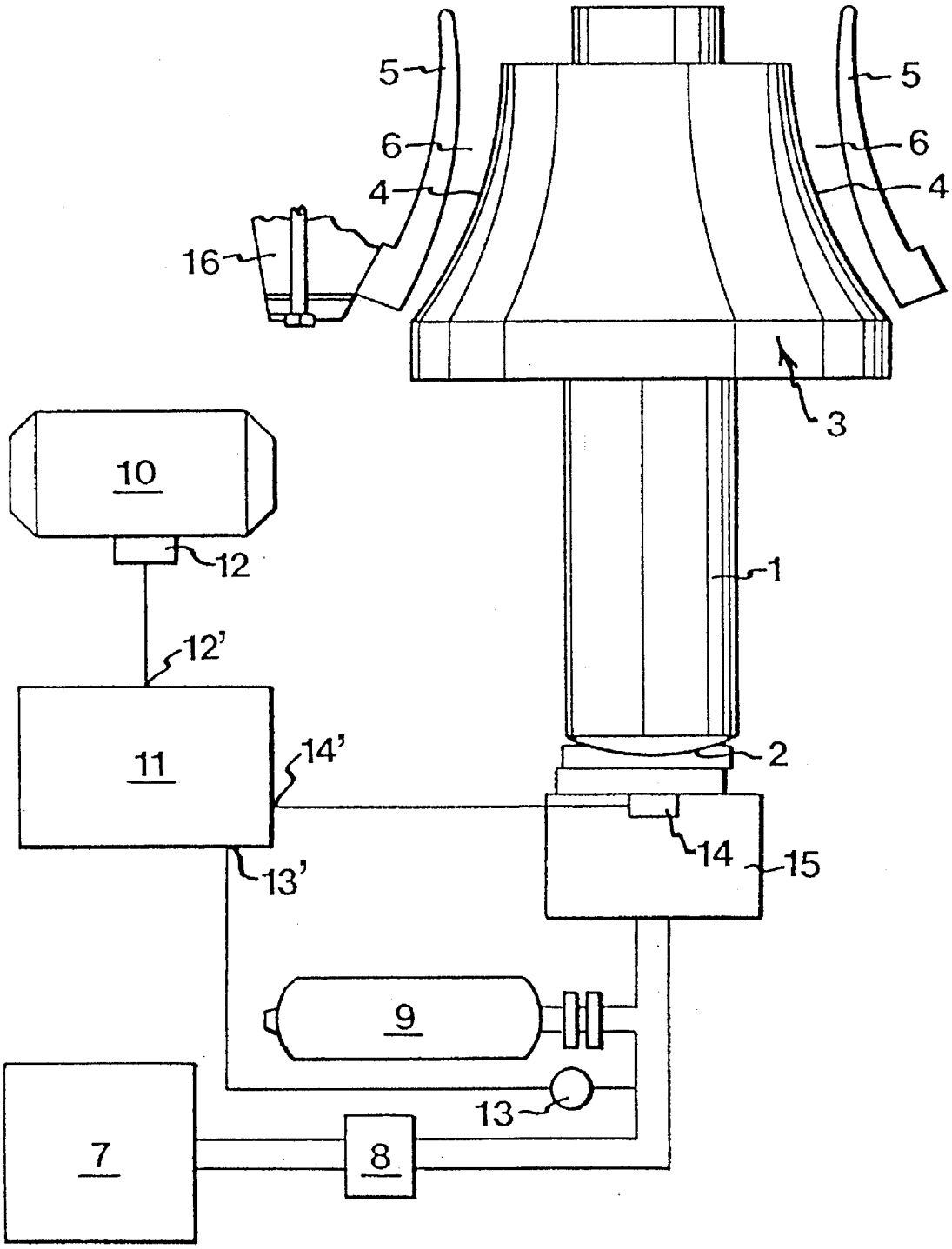

The present invention relates to a method for controlling a gyratory crusher so as to maintain a substantially constant crushing gap or to adjust the particle size distribution of the crushed goods, or both to maintain a substantially constant crushing gap and to adjust the particle distribution of the crushed goods.

The invention relates to a gyratory crusher having a crushing head with a first crushing shell, and a second crushing shell defining, together with the first crushing shell, a crushing gap whose width is adjustable by changing the relative position of the first and the second crushing shell in the axial direction by means of a hydraulic adjusting device, the material to be crushed being introduced into the crushing gap and a driving device causing the crushing head to execute a gyratory pendulum movement.

In the operation of such gyratory crushers, the crushing head is so adjusted that a certain predetermined width of the gap between the first, inner crushing shell and the second, outer crushing shell is obtained. The adjustment operation is performed manually and in such a manner that there is a certain safety margin up to maximum permissible crusher load. Since the load on the crusher will vary during the crushing operation, too narrow a gap would involve the risk of overload on the crusher with ensuing damage. As crushing proceeds, the shell surfaces are worn, which increases the gap width, thereby reducing productivity. To counteract this development, the axial position of the crushing head is adjusted gradually, either manually or automatically, to obtain the gap width as originally set.

Swedish Patent Specification 8601504-7 (SE-B-456,798) teaches a method for controlling such a gyratory crusher in order to avoid damage caused by caking in the crushing chamber between the outer and the inner crushing shell. Caking may arise if the material is supplied incorrectly or if the composition of the material supplied is not right (e.g. if the material contains too much moisture or too many pieces of stone which are harder than the remaining material). Thus, caking may cause high, but brief load peaks resulting in brief pressure increases, so-called pressure surges. Prior-art crushers are therefore equipped with a load-relieving system dealing with such temporary load peaks. In the above Swedish patent, such a system for dealing with temporary load peaks is combined with adjustment based on a determined value of the number of pressure surges in the hydraulic fluid of the adjusting device that exceed a predetermined pressure level in a given period of time, the relative position of the crushing shells being changed depending on this value to increase the width of the crushing gap if the calculated number of pressure surges exceeds a predetermined sum.

PCT Publication WO87/01305 discloses a readjustment of the width of the crushing gap by now and then bringing the crushing shells together to obtain a reference value for the subsequent adjustment of the crushing gap during the next operational period. Thus, this publication merely describes conventional calibration of a cone crusher during a crushing operation.

EP-A-0 429 237 discloses a safety device for preventing overload of the cone crusher with ensuing damage. In this device, the upper part of the chamber housing of the crusher is pressed downwards towards the main frame of the crusher. If there is an overload, the downwardly-directed force is relieved by temporarily raising the upper part of the chamber housing of the crusher. The use of this safety device does not involve any controlled variation of the crushing force.

Swedish Published Application 8601353-9 (SE-B456, 138) and the corresponding U.S. Pat. No. 4,856,716 disclose a method for operating a cone crusher, in which the power consumption, the pressure load on the crushing head and the width of the crushing gap are continuously measured. The measured values are then used for maintaining the width of the crushing gap on a level above a determined minimum value by correlating the power consumption and the pressure load in accordance with a set formula.

The present invention represents an improvement of the invention described in the above Swedish Patent Specification 8601504-7 (SE-B-456,798) and has, as one object, to provide safer and more effective control of the operation of the crusher as well as an enhanced adjustability in respect of the particle size distribution of the crushed goods.

This and other objects of the invention are achieved if the crusher is operated in accordance with the method defined in the appended claims.

In the inventive operation of a gyratory crusher having two crushing shells defining between them a crushing gap, the width of the gap is adjusted depending on the determined wear of the crushing shells. The wear is calculated on the basis of reference data on the established rate of wear of the crushing shells in previous crushing operations involving the same or a similar raw material. To adjust the particle size distribution of the crushed goods and obtain the desired particle size distribution curve, the crusher may, in the method according to the invention, be operated with brief periods of alternatingly different settings of the width of the crushing gap and/or with alternating crushing power or crushing force.

According to one aspect, the invention thus provides a method for controlling a gyratory crusher of the type mentioned by way of introduction. This aspect of the invention is distinguished by performing the adjustment of the crushing gap depending on an estimated wear of the crushing shells calculated on the basis of reference data on the established rate of wear of the crushing shells in previous crushing operations involving the same or a similar raw material. According to this aspect of the invention, the gyratory crusher is first calibrated, either by bringing the two shells of the crusher into engagement with each other or by inserting a piece of lead or some other spacing element between the shells. After a certain period of crushing, another calibration is performed in the same way to determine the axial displacement of the crushing head in relation to the frame of the crusher required to regain the desired width of the gap, thereby to enable determination of the rate of wear under given crushing conditions. In the continued crushing operation, the calculated rate of wear is then used as input data for the control device of the crusher for automatically displacing the crushing head in relation to the outer crushing shell to compensate for the estimated wear. However, since the wear is not always the same per unit of time, the adjustment should, by way of precaution, be performed at a value slightly below the estimated value.

According to another aspect of the invention, the gyratory crusher is controlled in such a manner that the particle size distribution of the crushed goods is adjusted to the desired particle size distribution curve. According to this aspect, the crusher is operated with alternating brief periods of different settings of the width of the crushing gap. For example, the crusher may be operated, during one operational period, with a set maximum crushing power or crushing force and, during another operational period, with a set constant width of the crushing gap.

During the operational period with the set maximum crushing power or crushing force, the axial position of the crushing head in relation to the frame of the crusher should be monitored to avoid any direct contact between the two crushing shells.

In an especially preferred embodiment of the invention, the relative position of the crushing shells can be readjusted, during the operational period with a set crushing power or crushing force and/or the operational period with a set gap width, by simultaneous monitoring of the axial position of the crushing head in relation to the frame of the crusher and monitoring of the set maximum crushing power or crushing force, and readjustment of the axial position of the crushing head in relation to the frame of the crusher on the basis of reference data from previous crushing operations involving the same or a similar raw material.

Figure 2:
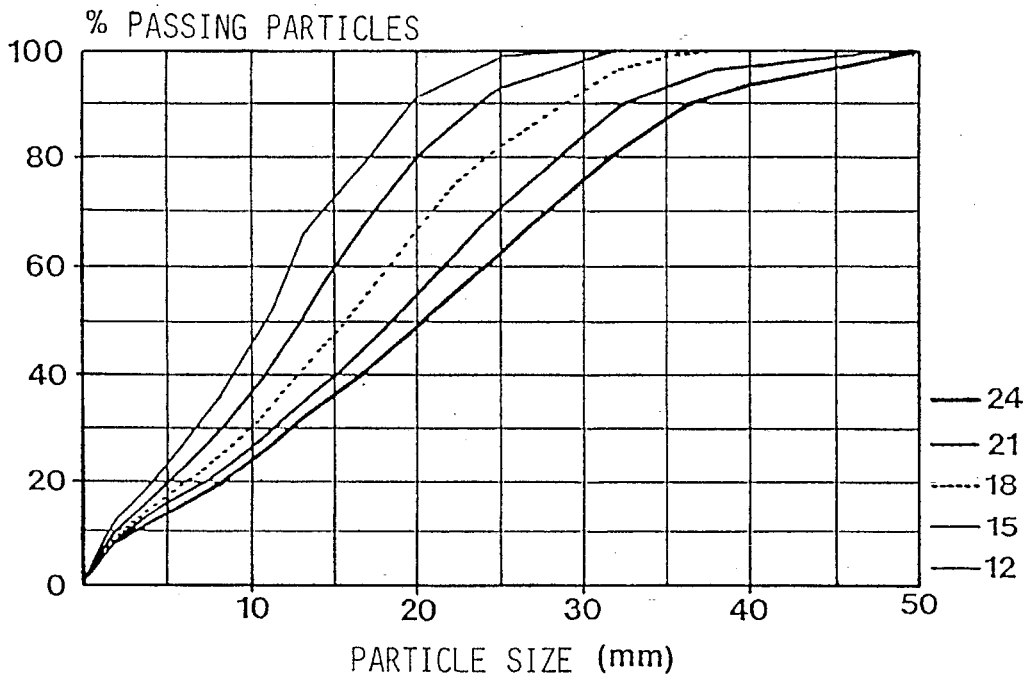
Figure 3:
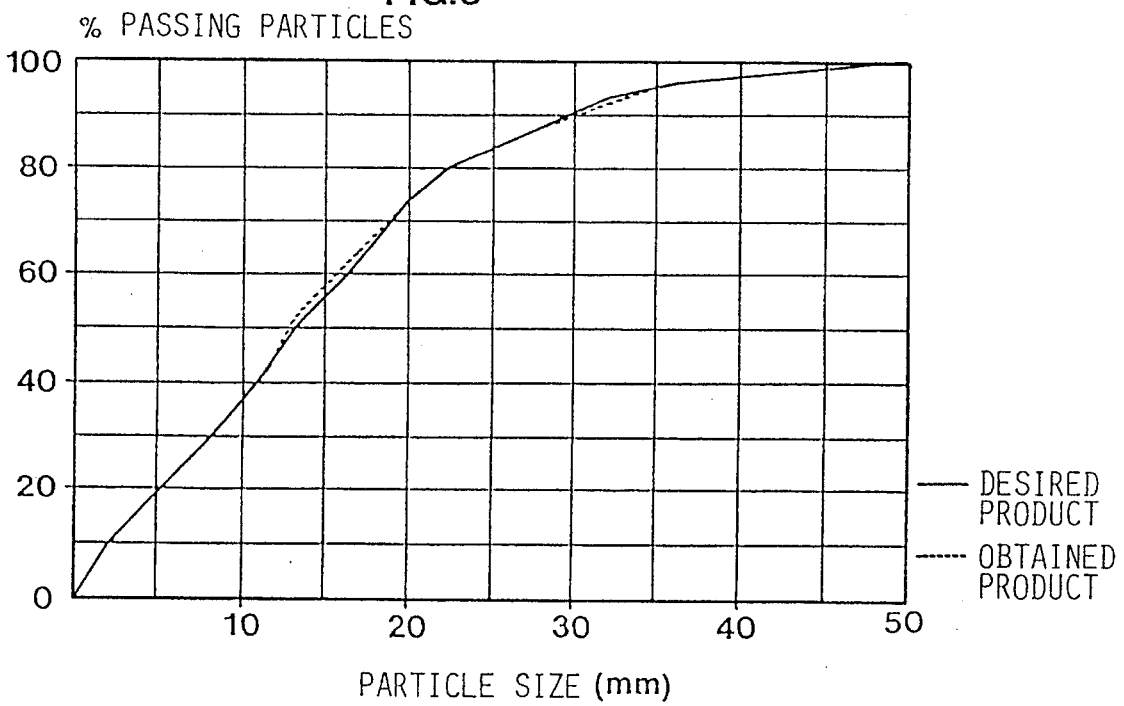

The invention will be described in more detail below with reference to the accompanying drawings, in which FIG. 1 schematically illustrates a gyratory crusher with associated driving, adjusting and control devices;

FIG. 2 contains a series of particle size distribution curves obtained for different settings of the crushing gap at an approximately constant gap width during the entire crushing operation; and FIG. 3 is a diagram showing a desired as well as an attained particle size distribution curve achievable by adjusting the crushing gap in accordance with the invention.

In the embodiment illustrated, it is assumed that the position of the crushing head (i.e. the position of the first crushing shell) is changed when the relative position of the crushing shells is altered, and that the width of the crushing gap is reduced when the crushing head is lifted in the axial direction.

The gyratory crusher shown in FIG. 1 comprises a shaft 1 which is eccentrically mounted at the lower end 2. At the upper end, the shaft carries a crushing head 3. A first, inner crushing shell 4 is mounted on the outside of the crushing head. In the machine frame 16, a second, outer and annular crushing shell is mounted so as to surround the inner crushing shell 4 with which it defines a crushing chamber. This chamber is in the form of a gap 6 which in axial section, as shown in FIG. 1, has a width that decreases downwards. The shaft 1 is vertically adjustable by means of a hydraulic adjusting device 15. The crusher also comprises a motor 10 which, in operation, causes the shaft 1 and the crushing head 3 to execute a gyratory pendulum movement, i.e. a movement during which the two crushing shells 4, 5 approach one another along a rotating generatrix and move away from one another along a diametrically opposed generatrix.

In operation, the crusher is controlled by a control device 11 which, at an input 12', receives input signals from a transducer 12 arranged at the motor and measuring the load on the motor. At an input 13', the control device 11 receives signals from a pressure transducer 13 sensing the pressure of the hydraulic fluid in the adjusting device 15. At an input 14', the control device 11 in addition receives signals from a level transducer 14 sensing the vertical position of the shaft 1 in relation to the machine frame.

When the crusher is to be put in operation, a calibration is first performed. Thus, the pump 18 pumps hydraulic fluid into the tank 7 until the shaft 1 has reached its vertically lowermost position. In this position, the distance between the crushing head 1 and a fixed point in the machine frame is measured. The measured value is then supplied to the control unit as representing the distance corresponding to the signal from the level transducer 14. Subsequently, hydraulic fluid is pumped into the system from the tank 7 until the inner shell 4 is applied against the outer shell 5. When the inner shell thus comes into contact with the outer shell, there is a pressure surge in the hydraulic fluid which is recorded by the pressure transducer 13. In this position, the above distance is measured and supplied to the control unit as representing the signal from the level transducer 14 for this position. Knowing the gap angle between the inner shell 4 and the outer shell 5, one may then determine, with the aid of the two calibration values measured, the gap width for any position of the shaft 1.

In this method, calibration is based on a position in which the inner and the outer shell touch each other. However, it is possible to base calibration on a position in which the crushing shells do not touch but in which a set gap width has been established by measuring with the aid of a piece of lead or some other spacing element introduced into the gap. Otherwise, calibration is performed in a similar manner.

When the method according to the invention is utilised to achieve automatic calibration and to maintain the crushing gap substantially constant during the crushing operation, the wear of the crushing shells is calculated. This is done by determining the distance of displacement from the first manual calibration to the next manual calibration (compared with the same reference gap) and taking into consideration the time the crusher has operated under load (i.e. not idling). Then, the displacement measured is divided by the operating time, giving a measurement of the rate of displacement or wear, e.g. in millimeters per hour.

With the knowledge of how much the shaft 1 has to be displaced per unit of time owing to wear, the control unit 11 is, in continued operation, caused to automatically compensate for the wear at regular intervals, once per hour. For safety reasons, wear compensation should not be carried out to the full, since the wear of the crushing shells may vary with time. This is so because the abrading properties of the crushed material are not constant, the size distribution of the supplied material varies or the load of the crusher is not constant. Several factors may concur.

After the first occasion of calculation mentioned above, the circuits of the control unit are connected for automatic calibration. The control unit adjusts the axial position of the crushing head depending on the rate of displacement or wear measured. As a matter of precaution, compensation may be carried out by a factor of e.g. 0.3 or 0.5 of the estimated wear.

After a certain period of operation, another manual calibration is performed to obtain a second occasion of calculation. The control unit may be programmed not to make any new calculation prognoses until there has been a displacement of e.g. 10 mm from the preceding prognosis. If this manual calibration shows that the rate of wear is lower than expected, the safety margins can be reduced so that compensation for the estimated wear can be increased in subsequent operation. If, on the other hand, the wear, and consequently the rate of displacement, varies considerably with time (e.g. if different types of goods or goods having highly varying properties are being crushed), the safety factor may perhaps never be raised above e.g. 0.3. It may even be necessary to interrupt automatic calibration.

Naturally, manual calibrations can be performed whenever desired, but calculations and subsequent check-ups should always be carried out after a predetermined minimum distance of displacement (10 mm in the above example) if measuring errors are not to have an adverse effect on the result.

The automatic calibration described above is advantageous in that it eliminates a common inconvenience, namely that the actual gap increases as the shells are worn, despite the fact that the gap set by the control device remains the same. In prior-art techniques, the set gap is only correct for a brief period after calibration. If automatic calibration is performed in accordance with the invention, the control device 11 will gradually lift the main shaft 1 and reduce the gap 6, such that the desired, set gap is maintained for a much longer period of time. Thus, the actual gap will not increase as rapidly as before, and much fewer manual calibrations of the gyratory crusher are thus required when using the invention.

When using the invention, the control device 11 may also control the crushing operation by maintaining a specific, selected crushing power or crushing force. If, in this type of operation, use is made of the above automatic compensation for wear, more time may elapse between successive manual calibrations of the gap.

The control technique may be utilised if one wishes to obtain an essentially constant size of the product as well as automatic compensation for wear. If so, the crushing procedure begins with manual adjustment of the gap until the desired product has been obtained. Then, power and force are read, and the resulting values are then inputted as maximum permissible power and force. The control device 11 will then operate at the set power and force and automatic wear compensation meaning that the control device 11 adjusts the main shaft 1 upwards to compensate for the wear and to maintain the load.

When the invention is used for affecting the particle size distribution of the crushed goods, the crusher should be operated during brief periods of alternatingly different settings of the width of the crushing gap 6. This aspect of the invention will be described in more detail below.

If a gyratory crusher is operated with an essentially constant crushing gap during the crushing operation, particle size distribution curves of the type shown in FIG. 2 are obtained. If, for instance, the gap is 24 mm, the particle size distribution curve farthest to the right can be obtained during an operational period. Likewise, the other curves can be obtained with gap widths of, respectively, 1 mm, 18 mm, 15 mm and 12 mm. When the gap width is altered, the general shape of the curves is thus basically maintained, but there is an anticlockwise angular rotation when the crushing gap is reduced. However, one often desires to obtain particle size distribution curves of completely different shapes and types, which may depend on the purpose of the crushed product. The invention provides the possibility of affecting the particle size distribution of the crushed product by periodic alterations of the operational conditions.

FIG. 3 shows a desired particle size distribution curve for a product, indicated by a full line. Such a curve cannot be obtained by crushing with a constant gap in accordance with FIG. 2. However, the idea is to combine two or more product yields into a new desired product yield. In the method according to the invention, this can be achieved by causing the control device to periodically change the gap width between two set positions. These positions can be obtained by switching between two different types of operational periods, namely a first operational period in which the automatic setting system strives to maintain constant a specific set high crushing power for a high degree of crushing of the material through a comparatively narrow crushing gap, and a second operational period in which the automatic setting system strives to maintain constant a specific comparatively broad set gap for a lower degree of crushing of the material. The control device 11 can be programmed so as to provide switching between these two operational positions at desired points of time. For instance, the highest possible power and force can be allowed during one period to give maximum crushing. The yield obtained during this period may then contain enough fine material, while there is a lack of coarse material. More coarse material can be produced by running the second operational period with a larger gap than in the preceding period. If the crusher is allowed to work for e.g. 60 s with the narrow gap and 45 s with the broader gap, this results in two different product yields which are physically separated immediately after the crusher. After the customary few intermediate storages and reloadings, the two yields are, however, mixed into a single product having the desired distribution of fine and coarse material. The durations of the different operational periods should be chosen while taking into consideration the handling of the crushed goods after crushing, as well as the agitation and mixing achieved during handling. Durations of 30–120 s may be suitable, depending on the aimed-at particle size distribution curve.

According to this aspect of the invention, the crusher can thus be operated with a set high crushing power or crushing force during the one operational period and operated with a set crushing gap width during the other operational period. Alternatively, the crusher may, during the one operational period, be operated with a set narrow crushing gap and, during another operational period, be operated with a broad crushing gap. In both instances, the crusher can be operated while monitoring the axial position of the crushing head in relation to the frame of the crusher in order to avoid any direct contact between the two crushing shells. A third possibility is to operate the crusher during different periods of alternating high and low crushing power or crushing force.

In the above examples, use is made of two different sets of operation parameters in the modification of the particle size distribution of the crushed goods. If desired, use may, of course, be made of three or more different sets of operation parameters to obtain additional advantages.

Preferably, the crusher is however preset, during the operational period with set maximum crushing power or crushing force, at a specific chosen gap width. The relative position of the crushing shells is then readjusted by simultaneous monitoring of the axial position of the crushing head in relation to the frame of the crusher and monitoring of the set maximum crushing power or crushing force, as well as by readjustment of the axial position of the crushing head in relation to the frame of the crusher on the basis of reference data from previous crushing operations involving the same or a similar raw material.

We claim:

1. A method for controlling a gyratory crusher having a frame supporting a crushing head (3) with a first crushing shell (4), and a second crushing shell (5) defining, together with the first crushing shell (4), a crushing gap (6) whose width is adjustable by changing the relative position of the first and the second crushing shell (4, 5) in the axial direction by means of a hydraulic adjusting device (15), the material to be crushed being introduced into the crushing gap (6), and a driving device (10) causing the crushing head (3) to execute a gyratory pendulum movement, said method comprising the steps of adjusting the particle size distribution of the crushed goods to the desired particle size distribution curve by operating the crusher, such that the width of the crushing gap (6), periodically and with preset operational time periods, changes between two crushing gap settings, at least one of the two crushing gaps being determined by a preset selected gap width (6) and at least one being determined by a preset, selected maximum crushing power or maximum crushing force; and, readjusting the relative positions of the crushing shells (4, 5) during the operational time periods by simultaneously monitoring the relative axial position of the crushing head (3) in relation to the frame of the crusher, and monitoring the set maximum crushing power or crushing force.

2. A method as set forth in claim 1 comprising the step of operating said crusher during the operational time periods with a set maximum crushing power or crushing force while monitoring the relative axial position of the crushing head (3) in relation to a frame (16) of the crusher to avoid any direct contact between the two crushing shells (4, 5).

3. A method as set forth in claim 2, comprising the steps of controlling the crusher during the operational time periods by selecting maximum crushing power or maximum crushing force in such a manner that the axial position of the crushing head (3) in relation to the frame (16) of the crusher is readjusted to compensate for wear calculated on the basis of reference data on the established rate of wear on previous crushing operations involving the same or a similar raw material.

4. A method as set forth in claim 1, comprising the steps of operating the crusher with alternating periods of different crushing force settings that are maintained by variations of the width of the crushing gap (6).

5. A method as set forth in claim 1, comprising the steps of controlling the crusher, during said operational time periods with maximum crushing power or maximum crushing force selected in such a manner that the axial position of the crushing head (3) in relation to the frame (16) of the crusher is readjusted to compensate for wear calculated on the basis of reference data on established wear ratios in previous crushing operations involving the same or a similar raw material.

6. A method as set forth in claim 1 comprising the steps of monitoring, during operation of the crusher, the axial position of the crushing head (3) in relation to a frame (16) of the crusher to avoid any direct contact between the two crushing shells (4, 5), and by operating the crusher with periods in which the crushing force is substantially maintained by variations of the width of the crushing gap (6).

7. A method as set forth in claim 1, comprising the steps of operating the crusher with periods of substantially constant crushing power being maintained by variation of the width of the crushing gap (6).

8. A method as set forth in claim 7 comprising the steps of monitoring, during operation of the crusher, the axial position of the crushing head (3) in relation to a frame (16) of the crusher to avoid any direct contact between the two crushing shells (4, 5) and further characterized by readjusting, during the operational period with substantially constant crushing power and the operational period with set width of the crushing gap (6), the relative position of the crushing shells (4, 5) by simultaneous monitoring of the axial position of the crushing head (3) in relation to the frame (16) of the crusher and monitoring of the set maximum crushing power, and readjustment of the axial position of the crushing head (3) in relation to the frame (16) of the crusher on the basis of reference data from previous crushing operations involving the same or a similar raw material.

9. A method as set forth in claim 7 comprising the steps of monitoring, during operation of the crusher, the axial position of the crushing head (3) in relation to a frame (16) of the crusher to avoid any direct contact between the two crushing shells (4, 5) and by readjusting, during the operational period with set width of the crushing gap (6), the relative position of the crushing shells (4, 5) by simultaneous monitoring of the axial position of the crushing head (3) in relation to the frame (16) of the crusher and monitoring of the set maximum crushing power, and readjustment of the axial position of the crushing head (3) in relation to the frame (16) of the crusher on the basis of reference data from previous crushing operations involving the same or a similar raw material.

10. A method as set forth in claim 7 comprising the steps of monitoring, during operation of the crusher, the axial position of the crushing head (3) in relation to a frame (16) of the crusher to avoid any direct contact between the two crushing shells (4, 5) and by so controlling the crusher, during operational periods with a relatively broad crushing gap (6), either set at a predetermined value or maintained at such a setting that it gives the desired set crushing motor power, that the relative position of the crushing shells (4, 5) is readjusted by simultaneous monitoring of the axial position of the crushing head (3) in relation to the frame (16) of the crusher and monitoring of the set limit for the crushing motor power, such controlling of the crusher being performed by readjustment of the axial position of the crushing head (3) in relation to the frame (16) of the crusher to compensate for wear calculated on the basis of reference data on the established rate of wear on previous crushing operations involving the same or a similar raw material.

* * * * *